US006358558B1

(12) United States Patent
Viitanen

(10) Patent No.: US 6,358,558 B1
(45) Date of Patent: Mar. 19, 2002

(54) METHOD FOR FEEDING A WEB TREATING AGENT TO A PAPER OR BOARD WEB PROCESSING APPARATUS

(75) Inventor: Markku Tapio Viitanen, Vallealoshi (FI)

(73) Assignee: Valmet-Raisio Oy, Raisio (FI)

( * ) Notice: Subject to any disclaimer, the term of this patent is extended or adjusted under 35 U.S.C. 154(b) by 0 days.

(21) Appl. No.: 09/316,373

(22) Filed: May 21, 1999

(30) Foreign Application Priority Data

May 25, 1998 (FI) ..... 981156

(51) Int. Cl.[7] ..... B05D 1/26

(52) U.S. Cl. ..... 427/8; 427/356; 427/345; 118/712; 118/410; 118/602

(58) Field of Search ..... 427/356, 345, 427/8; 118/410, 602, 712

(56) References Cited

U.S. PATENT DOCUMENTS 4,050,410 A * 9/1977 Stroszynski ..... 118/410
5,133,996 A 7/1992 Busker ..... 427/356
5,882,408 A * 3/1999 Fujita ..... 118/684

* cited by examiner

*Primary Examiner*—Katherine A. Bareford
(74) *Attorney, Agent, or Firm*—Cohen, Pontani, Lieberman & Pavane

(57) ABSTRACT

A method and apparatus for feeding a treating agent to an apparatus (1, 2) employed in the treating of a paper or board web for applying the treating agent to the surface of the web being treated. The treating agent is prepared and then supplied to the apparatus used for applying the treating agent, into the applicator chamber thereof, wherefrom the treating agent is further applied to a moving surface. The treating agent is first supplied into a feed chamber (2) communicating with the applicator chamber, and the feed chamber (2) is provided with a shunt line (10, 11) serving to remove the excess amount of the treating agent supplied to the feed chamber (2) that is not adhered to the moving surface. A pressure measurement signal at a point (22) representing the internal pressure of the feed chamber is obtained, and the feed pressure of the treating agent is adjusted to a value causing the internal pressure of the feed chamber to attain its desired set value.

11 Claims, 1 Drawing Sheet

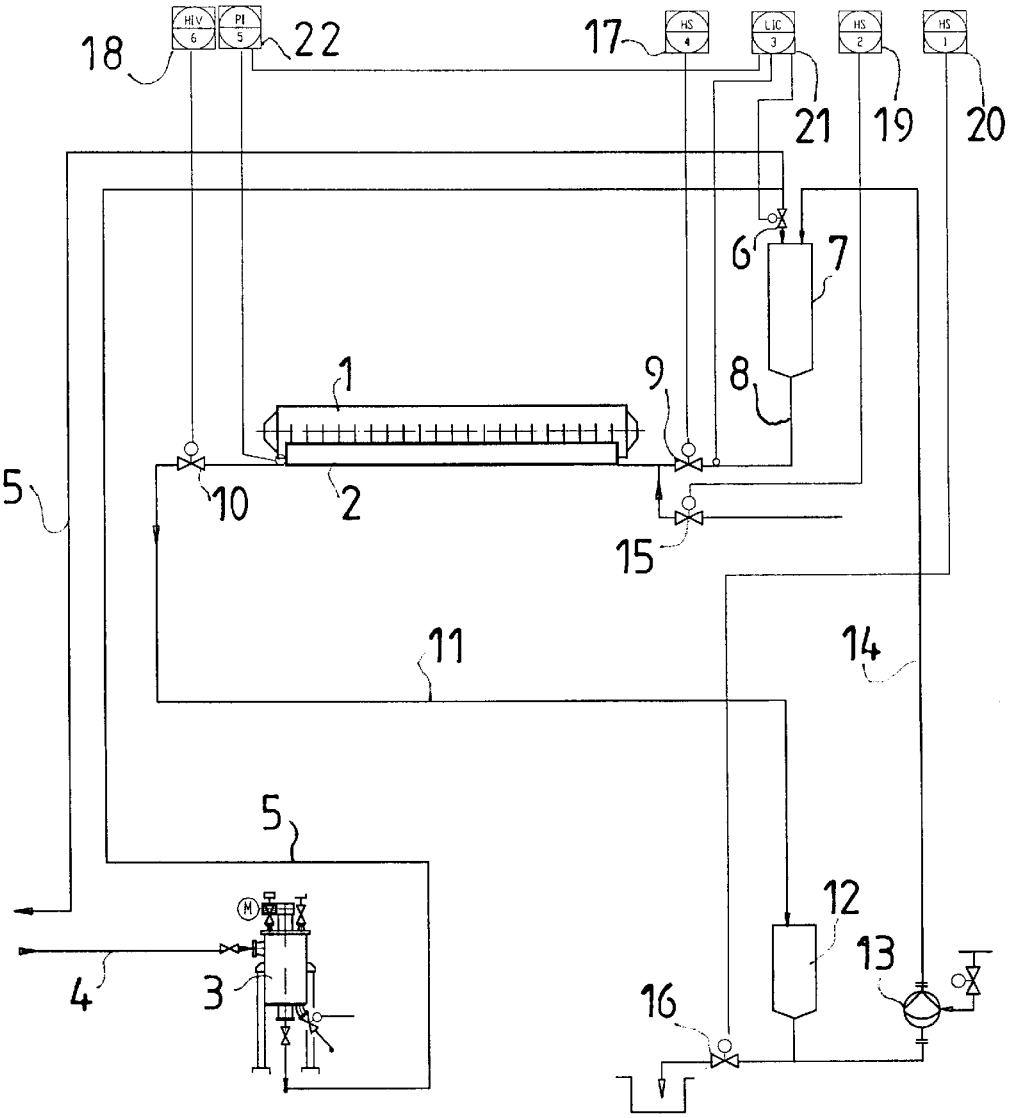
HIV 6
PI 5
HS 4
LIC 3
HS 2
HS 1
18
22
17
21
19
20
6
7
8
9
1
2
10
5
15
11
14
5
12
13
4
3
16
M

METHOD FOR FEEDING A WEB TREATING AGENT TO A PAPER OR BOARD WEB PROCESSING APPARATUS

FIELD OF THE INVENTION

The present invention relates to a method and apparatus for feeding a coating mix, size or other web treating agent to a paper or board web processing apparatus in which the agent is applied to the web surface. More specifically, the invention relates to the machine circulation of a sizing press or coating station.

BACKGROUND OF THE INVENTION

In the coating of a paper or board web, to the surface of a base sheet are applied different kinds of treating agents serving to improve the strength and printability of the web. Most conventionally, a surface sizing agent and various coating mixtures are employed. The web treating agent can be applied in various manners to the web being processed. In the art of coating, the coater equipment may be selected, e.g., from the groups of roll coaters such as film-transfer coaters, short-dwell coaters and spray or jet coaters. Using the applicator apparatus, an excess amount of coat is applied to the base sheet surface and the applied coat is smoothed to a desired thickness by a doctoring device. In surface sizing, the treating agent used for treating the web penetrates into the base sheet, thus disposing with any need for doctoring. In modern coaters, the applicator apparatus is designed to allow flooding of the coating mix over the confining boundary element located at the coater incoming side such as a blade or a rod. The purpose of the continuous flooding is to prevent the entry of air travelling along with the web into the applicator chamber and to provide a linear web wetting line at the incoming side, whereby a constant coating mix dwell time profile in the cross-machine direction over the web is attained and the surface profile of the coated product becomes smoother. To achieve a stable overflow, an excess amount of the coating mix is pumped into the applicator chamber and the excess coating mix flooding at the incoming side over the applicator chamber wall or the confining boundary element is collected and circulated back into the machine tank. The return flow of coating mix is passed via a strainer, is purged free from entrained air and then is returned to the coating mix circulation.

The pumping of excess coating mix and the open structure of the return circulation involve a number of problems. The greatest complications are caused by the air and foreign matter entrained in the circulating treating agent. Air can become entrained in the circulating treating agent in the return pipe which must be overdimensioned so that it will never become fully plugged by the treating agent. The coating mix circulated via the applicator chamber meets the web surface during application, whereby it gathers fibers detached from the web surface. In concurrent machine circulation systems of coating mix, removal of air and foreign matter from the treating agent is accomplished by air traps and strainers that must be dimensioned for high volumetric flows, because the proportion of the return flow may be up to 90% of the overall flow of the treating agent directed to meet the web surface. Due to the large volume of the coating mix flow, also the other parts of the coater equipment must be made large thus requiring a large footprint. As coating mixes especially have a high viscosity and are difficult to handle, their straining and entrained air purging are clumsy to arrange and require costly equipment of high efficiency. The equipment must have a high capacity that makes the implementation of the machine circulation of coating mix an expensive investment when using conventional arrangements. Removal of air and foreign matter from the circulating coating mix, however, is mandatory inasmuch both of these disturbing factors will otherwise cause defects on the coated web of paper or board. The large volumetric flow also means a large volume of coating mix contained in the machine circulation at a time. Furthermore, the circulation system of the web treating agent may entail spaces that are supportive to the growth of bacterial cultures. This is a significant problem when using organic size formulations, because the size containing warm water and air will be readily contaminated by microbes. To avoid the growth of microbial cultures, biocides must be added to the sizing used in the size circulation thus causing extra costs and hampering the processing of waste waters containing such web treating agents.

SUMMARY OF THE INVENTION

It is an object of the present invention to provide a method and apparatus suited for feeding a web treating agent to such web processing apparatuses employed in the manufacture of paper and board that do not have a return circulation arrangement for the treating agent flooding from the applicator.

The goal of the invention is achieved by way of adapting a shunt flow facility to the coating mix applicator chamber and then measuring the pressure head of the applicator chamber and adjusting the inlet flow rate of the coating furnish so as to keep the applicator chamber head at a desired level.

According to a preferred embodiment of the invention, the positive inlet flow pressure, that is, the infeed pressure to the applicator chamber, is adjusted to a proper level by utilizing the hydrostatic head of the treating agent flowing from a machine tank disposed at a suitable height in regard to the applicator chamber.

The invention offers significant benefits.

The most important benefit of the invention is that the web treating furnish can be kept entirely fresh and free from entrained air, whereby there is no need for straining and purging of entrained air and yet the quality of the treated/coated web surface remains defect-free. The greatest benefit of the system having no open return circulation is attained in size presses which have no return circulation for the excess size doctored away from the surface of the treated web or, alternatively, in coating methods which directly apply to the paper or board sheet surface the correct amount of coat needed for a desired final coat thickness, thus disposing with the doctoring step. Such coating techniques are feasible at least by means of some film-transfer coaters and jet applicators obviously, any system involving a doctoring step must subject the return circulation of the treating agent to straining and/or purging of entrained air prior to the reuse of the treating agent removed by doctoring. Another significant benefit is the substantial reduction of the footprint required by the equipment and the system and the lesser amount of treating agent required in the machine circulation. As no purging of entrained air or straining of the treating agent is needed, the arrangement is more cost-effective to implement. The smaller amount of circulating treating agent contributes to easier temperature control. The number of valves required in the machine circulation is reduced over that needed in a conventional system and the transducer installation and control instrumentation of the machine circulation is easier to implement. Inasmuch as the piping of the treating agent circulation system is always running full of treating agent and free from air, there is no risk of the drying of the agent in the piping and accumulating on the walls thereof, wherefrom it could then flake off as clumps that become entrained in the material flow thus possibly entering the applicator chamber and landing on the web with the applied coat. Elimination of this hazard is a significant advantage in coaters. Furthermore, the growth of microbial cultures in the treating agent is prevented by the anaerobic conditions, thus disposing with the need for biocide use. Owing to the minimal footprint requirement, the equipment of the machine circulation system can be mounted on the machine level, while conventional arrangements have the machine tank placed on the basement level and the strainers on the intermediate or machine level, thus necessitating a much longer overall length of machine circulation piping than is now possible in an arrangement according to the present invention.

Other objects and features of the present invention will become apparent from the following detailed description considered in conjunction with the accompanying drawing. It is to be understood, however, that the drawing is intended solely for purposes of illustration and not as a definition of the limits of the invention, for which reference should be made to the appended claims.

BRIEF DESCRIPTION OF THE DRAWING

In the following, the invention will be examined in greater detail by making reference to the FIGURE illustrating a schematic drawing of a preferred embodiment of the invention.

DETAILED DESCRIPTION OF THE PRESENTLY PREFERRED EMBODIMENTS

In the FIGURE is shown the machine circulation of the web treating agent and a portion of the transducer instrumentation of the same. The arrangement illustrated in the FIGURE relates to the machine circulation of the web treating agent in a film-transfer press used for applying a surface size. The present invention is particularly suited for implementing the machine circulation of such an apparatus. A film-transfer roll 1 and a treating agent feed chamber 2 represent the basic components of the film-transfer size press. From the feed chamber 2, the web treating agent is passed into the actual applicator chamber. The fresh treating agent circulation of the surface size includes a strainer 3 to which the web treating agent such as a surface size is passed over a line 4. From the strainer 3 the surface size is further passed to a circulating feed line 5 that may join to a line 4, thus forming a closed loop passed via the strainer 3. The size is pumped into the fresh size circulation from a storage tank (not shown) via the strainer 3 to the press station and the unused portion of the size is circulated back to the storage tank. This type of circulating feed line can be run at a constant pressure, and the continuously circulated pumping prevents the web treating agent from settling in the piping.

The circulating line 5 is provided with a valve 6 via which a portion of the circulating surface size can be tapped into a machine tank 7. Treating agent exist from the machine tank 7 toward the feed chamber 2 through an infeed line 8 equipped with a main infeed valve 9 for closing the same. Through an excess treating agent shunt valve 10 from the feed chamber 2 exits an excess treating agent shunt line 11 to an excess treating agent collection tank 12, wherefrom via a pump 13 is passed a return line 14 back to the machine tank 7.

Additionally, the machine circulation system of the web treating agent comprises a rinse water feed nozzle equipped with a rinse water line cutoff valve 15 and a rinse water discharge nozzle equipped with a drain valve 16, as well as the necessary instrumentation with the controllers of said valves inclusive. The valves 9, 10, 15 and 16 are driven by means of controllers 17–20. The level of the treating agent in the machine tank 7 is controlled by means of a level control circuit 21 whose feedback signal is obtained by pressure measurement at the treating agent feed chamber 2. The feed chamber pressure is measured by means of a pressure transducer 22 adapted to the chamber end wherefrom the excess treating agent shunt line 11 exits.

The machine circulation according to the invention operates as follows. As only a very exactly controlled amount of surface size needs to be supplied from the feed chamber 2 onto the film-transfer roll 1 and therefrom to the surface being treated, the required volumetric infeed rate of the surface size is very small. However, to achieve a smooth cross-machine profile of the applied treating agent, the applicator chamber pressure must be maintained constant over the entire width of the chamber 2. Further, the surface size must be circulated evenly throughout the entire volume of the feed chamber of the treating agent so that the whole content of the chamber is renewed in a given time, whereby no parts of the feed chamber can form stagnant spaces in which the treating agent can settle or otherwise foul the system. According to the invention, this goal is attained by feeding the surface size into the feed chamber 2 of the treating agent at its first end and then having the other end of the chamber 2 equipped with an excess treating agent exit line 11. The volumetric rate of the excess treating agent flow is controlled by means of a valve 10. The pressure in the treating agent feed chamber is measured at the exit end of the excess treating agent shunt line 11, and a set value of about 0.02 bar may be appropriately used for the treating agent feed chamber pressure, however, obviously allowing differences in the chamber pressure depending on the applicator type, amount of treating agent applied per unit area, dimensions of the applicator apparatus and other factors. From the feed chamber, the treating agent is passed into the applicator chamber proper of the size press, whereby a size press is typically operated with a positive pressure of 0.05 bar. The output signal of pressure transducer 22 is taken to a level control circuit 21 that controls the duty cycle of valve 6 so as to maintain the liquid level in the machine tank 7 such that it makes the hydrostatic head imposed by the liquid level in the machine tank keep the desired pressure in the feed chamber 2. Most advantageously, the pressure of the feed chamber 2 is measured at the opposite end of the feed chamber 2 in regard to the infeed point of the surface size, whereby the pressure drop over the feed chamber is appropriately taken into account.

With the help of the excess treating agent shunt valve 10, the volumetric flow rate of the shunt circulation can be adjusted to a proper value and the shunted amount of surface size is passed to the excess treating agent collection tank 12, wherefrom the unused treating agent is returned back to the machine tank 7 with the help of a pump 13. Thus, the amount of surface size tapped from the circulating line 5 into the machine tank 7 is exactly equal to the amount fed to the film-transfer roll 1 and therefrom, to the surface of the running web, because all the size passing via the excess treating agent shunt valve 10 is entirely returned back to the machine tank 7. A guideline value of the shunt flow is in the order of 1 liter of treating agent per minute and meter of cross-machine web width.

The rinsing of the system piping can be performed by first closing the main infeed valve 9, and at the lapse of a preset treating agent recovery delay, switching off the pump 13 and opening the drain valve 16. Herein, the size contained in the feed chamber 2, the excess treating agent shunt line 11 and the excess treating agent collection tank 12 is recovered into the machine tank 7.

Next, the rinse water valve 15 is opened to pass rinse water into the feed chamber 2 as well as into the shunt line 11 and the collection tank 12, wherefrom the used rinse water is discharged via the drain valve 16 to a drain channel. At the lapse of a preset rinsing delay, the rinse water valve 15 is closed and the main infeed valve is opened prior to the start of sizing/coating.

In addition to those described above, the invention may have alternative embodiments.

Instead of using a hydrostatic head to provide the treating agent feed pressure, the positive feed pressure can be accomplished by means of a pump adapted between the machine tank 7 and the main infeed valve 9, whereby the feed pressure of the treating agent could be controlled based on the output signal of the pressure transducer 22 by controlling the pump speed or a throttle valve placed in front of the pump. Such an arrangement, however, requires a fast response from the control circuit as well as from the pump and the throttle valve, additionally involving the risk of fast pressure variations and pressure pulsations in the feed chamber. A more advantageous technique of implementing treating agent supply to the feed chamber is to control the pressure of the circulating fresh treating agent supply line that is easier to stabilize as required, whereby any possible pressure variations can be compensated for by means of a throttle valve placed on the treating agent feed line. This type of control arrangement may also be complicated in regard to its practical implementation. When desired, the excess treating agent collection tank may be omitted from the excess treating agent shunt line, whereby the treating agent can be returned directly to the machine tank. Alternatively, the feed chamber pressure control can be accomplished through measuring the internal pressure of the applicator chamber inasmuch as the applicator chamber pressure directly reflects pressure changes in the feed chamber. Obviously, it is possible to use a combination of pressure measurements adapted in both the feed chamber and the applicator chamber.

Besides the above-described exemplifying embodiment, the invention can be adapted to other types of applicators used in treating a paper or board web by means of applying the treating agent on a moving surface such as a roll or directly to the web. One kind of such apparatuses comprises jet applicators, for instance.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawing is not necessarily drawn to scale but that it is merely conceptual in nature. It is the intention, therefore, to be limited only as indicated by the scope of the claims appended hereto.

What is claimed is:

1. A method for feeding a treating agent to an apparatus employed in the treating of a paper or board web by means of applying the treating agent to a moving surface of the web being treated, the method comprising:

supplying the treating agent to an applicator chamber of an apparatus used to apply the treating agent to a moving surface of the web being treated, the treating agent being applied to the moving surface of the web from the applicator chamber;

supplying the treating agent into a feed chamber, the feed chamber being in fluid communication with the applicator chamber so as to supply treating agent supplied to the feed chamber to the applicator chamber;

providing the feed chamber with a shunt line to remove an excess amount of the treating agent supplied to the feed chamber which is not adhered to the moving surface of the web upon application thereof by the applicator chamber;

measuring an internal pressure of the feed chamber; and setting a feed pressure of the treating agent into the feed chamber to a value so as to cause the internal pressure of the feed chamber to attain a desired pressure value.

2. The method of claim 1, wherein the internal pressure of the feed chamber is measured directly.

3. The method of claim 2, wherein the treating agent is supplied into the feed chamber through a supply line, and further comprising measuring an internal pressure of the applicator chamber and setting a pressure of the treating agent in the supply line to a value so as to cause the internal pressure of the applicator chamber to attain a desired pressure value.

4. The method of claim 1, further comprising:

supplying the treating agent to a machine tank positioned relative to the feed chamber so that a hydrostatic head imposed by a level of liquid in the machine tank can be made to be greater than a hydrostatic head in the feed chamber, the machine tank supplying the treating agent to the feed chamber; and adjusting the feed pressure of the treating agent into the feed chamber by controlling the level of treating agent pumped into the machine tank based upon the internal pressure of the feed chamber.

5. The method of claim 4, wherein the excess amount of the treating agent removed from the feed chamber by the shunt line is fed to the machine tank.

6. The method of claim 5, wherein the excess amount of the treating agent removed from the feed chamber by the shunt line is fed to the machine tank through a collection tank.

7. The method of claim 1, wherein the internal pressure of the feed chamber is measured at an end of the feed chamber opposite to an end of the feed chamber at which the treating agent is supplied into the feed chamber.

8. The method of claim 1, wherein the treating agent is supplied into the feed chamber by means of a pump.

9. The method of claim 8, wherein the feed pressure of the treating agent into the feed chamber is set by means of a control valve.

10. The method of claim 1, wherein the treating agent is supplied into the feed chamber from a supply line.

11. The method of claim 10, wherein the feed pressure of the treating agent into the feed chamber is set by means of a control valve.

* * * * *